United States Patent [19]

Godbersen

[11] 4,266,917

[45] May 12, 1981

[54] METHOD AND MACHINE FOR SLIP FORMING MEDIAN BARRIER WALLS FOR HIGHWAYS

[75] Inventor: Harold W. Godbersen, Ida Grove, Iowa

[73] Assignee: Gomaco, Inc., Ida Grove, Iowa

[21] Appl. No.: 29,262

[22] Filed: Apr. 11, 1979

[51] Int. Cl.[3] ..... B28B 7/02

[52] U.S. Cl. ..... 425/64; 249/8; 264/33; 425/466

[58] Field of Search ..... 425/64, 466; 264/33; 249/8

[56] References Cited

U.S. PATENT DOCUMENTS

| | | | |
|---|---|---|---|
| 3,507,015 | 4/1970 | Heatlie | 425/64 |
| 3,530,552 | 9/1970 | Calder | 425/64 |
| 3,600,773 | 8/1971 | Davis | 249/8 |
| 3,685,405 | 8/1972 | McDonald | 425/64 |
| 3,792,133 | 2/1974 | Goughnour | 264/33 |
| 3,957,405 | 5/1976 | Goughnour | 425/64 |

*Primary Examiner*—John Parrish

*Attorney, Agent, or Firm*—Rudolph L. Lowell; G. Brian Pingel

[57] ABSTRACT

This invention pertains to a method and machine for slip forming concrete wall structures such as median barrier walls for highways. The slip form comprises a pair of opposite side walls each of which has a skirt member retractable and extensible relative to the lower portion thereof. A top wall separate from the side walls is mounted on the machine frame between the upper portions of the side walls, and each side wall and associated skirt member is movable as a unit relative to the top wall and each skirt member is independently movable relative to an associated side wall. The side walls are adjustably supported on the machine frame for adjustment laterally of the machine frame to accommodate top walls of varying widths and the top wall is verticaly adjustable relative to the machine frame independently of the side walls. Power means provide for a controlled relative movement of the side walls, skirt members and top wall and the relative arrangement of the side walls and top wall is such that a glare shield can be formed over any selected section of the barrier wall without interrupting the continuous advance of the machine in the forming of the barrier wall with linear and reversely curved sections.

6 Claims, 23 Drawing Figures

METHOD AND MACHINE FOR SLIP FORMING MEDIAN BARRIER WALLS FOR HIGHWAYS

BACKGROUND OF THE INVENTION

The invention pertains generally to the field of slip forming concrete structures and in particular to a machine and method for slip forming the median barrier wall of a highway. These barrier walls are of a generally conventional shape in transverse cross section so as to have a wide base and upwardly and inwardly tapered side surfaces terminating in upright top portions. Since the configuration or contour of the side walls is fixed, such contour remains the same during a slip forming operation. The barrier walls over the linear sections thereof are usually symmetrical relative to a central vertical plane. However, when the slope of the highway varies, as in curves, the barrier wall becomes nonsymmetrical relative to such central vertical plane. The general cross sectional shape of the wall is usually dictated by specification requirements providing for sufficient strength to counteract vehicle impact forces and yet having an outer contour of a configuration adapted to minimize the full impact of the vehicle against the wall by providing a rebound action of the vehicle relative to the wall.

Apparatus for forming a wall of this general type is shown in U.S. Pat. No. 3,792,133. The slip form in a first disclosed embodiment in such patent includes a pair of side walls, one of which is fixed. The other side wall is vertically adjustable and has an upper portion integrally formed with a lateraly extended top section or wall. The lower end of the adjustable side wall is movable relative to a fixed plate member, the bottom edge of which is at the level of the lower edge of the fixed side wall.

This disadvantage is partly negatived in a second embodiment of a slip form disclosed in U.S. Pat. No. 3,792,133 by the provision of a pair of selectively adjustable side walls. Thus, when one of the side walls is to be adjusted, the opposite side wall must first be mechanically locked against movement. The slip form of either embodiment is without any means for adjusting the form side walls laterally of the machine frame relative to the form top wall, or for expanding the top wall to vary the thickness of barrier walls having side surfaces of similar configuration. Also, no provision is made for preventing at all times concrete from flowing under the side walls. These objections inherent in the slip form of U.S. Pat. No. 3,792,133 are eliminated by the slip form device and method of the present invention.

SUMMARY OF THE INVENTION

The machine and method of the invention provides for the efficient slip forming of highway median barrier walls of differing size and shape having any arrangement of linear and curved sections and while the machine is being advanced in a single direction. The lateral adjustablility of opposite side walls of the form, relative to the top wall, permits the use of the side walls with top walls of varying widths. The relative vertical adjustment of the top wall and side walls provides for a wide variation in the vertical height of a barrier wall particularly where a glare shield is to be formed on the barrier wall top surface. The slip forming of the glare shield takes place simultaneously and continuously with the slip forming of the barrier wall and over any selected portion of the wall while the machine is being advanced in a single direction. At any adjusted position of the slip form, the skirt member associated with each side wall is adjustable to prevent any flow of concrete from between the ground or highway surface and the form.

By virtue of the lateral adjustment of the side walls relative to the top wall of the slip form, top walls of varying widths may be used to selectively form walls of varying widths but of corresponding shapes in transverse cross section. Because of this, interchangeability of a plurality of top walls, or the use of a laterally adjustable top wall, with a single pair of side walls, form costs are appreciably reduced by eliminating the need of a separate or independent form for each width variation of a barrier wall having side surfaces of like contour.

DESCRIPTION OF THE INVENTION

Figure 1:
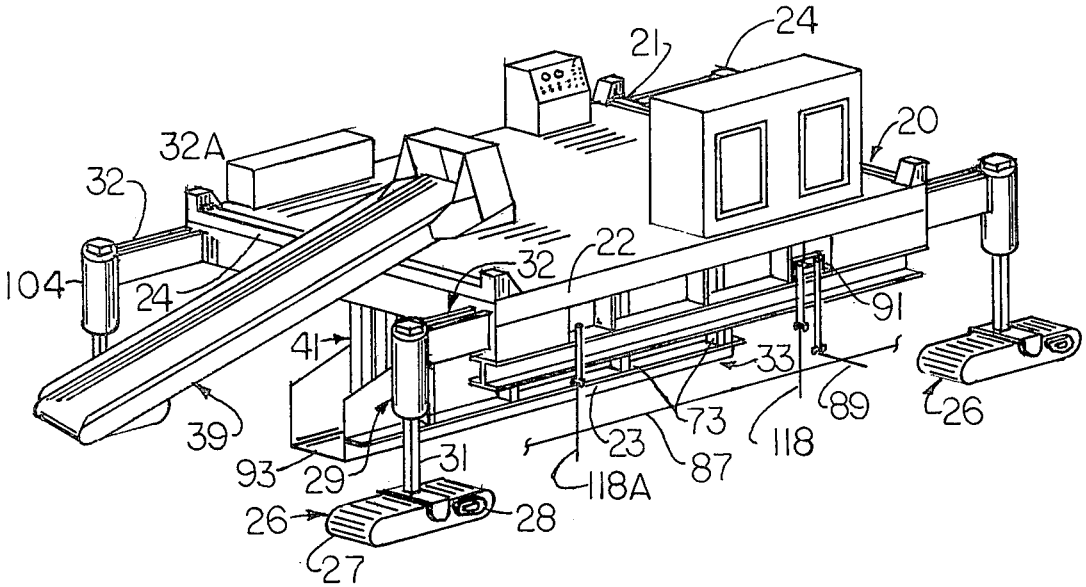
FIG. 1 is a side perspective view of the machine of this invention for forming a median barrier wall.

With reference to the drawings, there is illustrated in FIG. 1 the slip forming machine of this invention, indicated generally as 20 and having a main frame 21 of a generally rectangular shape in plan view formed with longitudinally extended vertically spaced beam members 22 and 23 and interconnecting transverse beam members 24 so that the frame 21 of the machine 20 is of a generally inverted U-shape in transverse cross section. Each corner of the frame 21 is ground supported on a steerable traction assembly or ground supporting unit 26. Each unit 26 includes an endless track 27 driven by an associated hydraulic motor 28. Each ground unit 26 is interconnected with the frame 21 by a cylinder assembly 29 that has a linearly adjustable member 31 connected to the ground unit 26 and a horizontally movable parallel link system 32 so that a ground unit 26 and associated cylinder assembly 29 are movable in a pivotal path laterally of the machine 20 from a transport position within the lateral confines of the frame 21 to a desired operating position. On linear adjustment of the member 31, the frame 21 is raised and lowered for conformance with a predetermined grade level for a purpose to appear later. By virtue of the parallel link connection of a cylinder assembly 29 with the frame 21, a track 27 extends longitudinally of and parallel with the longitudinal axis of the frame 21 at any laterally adjusted position of a ground supporting unit 26.

Figure 14:
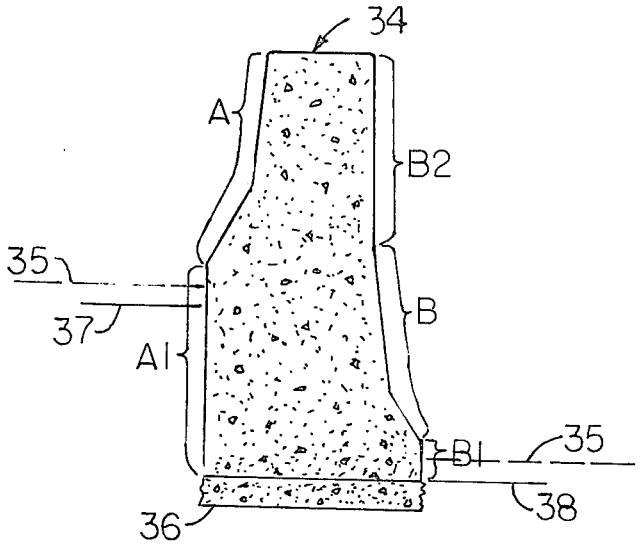
FIG. 14 is a diagrammatic illustration showing the nonsymmetrical transverse cross sectional shape of a barrier wall formed by the slip form when in its position of FIG. 13.

Positioned longitudinally of the frame 21 between the transversely opposite vertically spaced side structures thereof, formed by the beam members 22 and 23, is the slip form unit of this invention, indicated generally as 33. A typical highway barrier wall 34 that can be formed by the machine and method of this invention is shown in FIG. 14. The wall is usually supported on a concrete foundation 36 of a conventional construction. As will appear later, the form of this invention, if desired, can be utilized to form the foundation simultaneously with the forming of the barrier wall. The grade elevation lines on each side wall of the barrier 34 are represented at 37 and 38. Although the grade lines 37 and 38 are illustrated as being at different vertical levels, such difference in elevation is generally due to the elevational differences required in the formation of highway curves which, as is well known, are banked in order to resist centrifugal forces imposed upon moving vehicles. This difference in the grade elevations 37 and 38 may vary from zero inches to eighteen inches or more.

Each side surface of the barrier wall 34 is comprised of surface portions having a generally similar configuration except that the vertical dimension of several of such surfaces differ due to the difference in elevation between the grade lines 37 and 38. Thus, the surface portions indicated by A and B at opposite sides of the wall 34 are generally the same. Although the surfaces indicated as A1 and B1 extend vertically, the surface A1 is of appreciably greater vertical height to compensate for the variation in the grade line levels 37 and 38. Correspondingly, the surface B2 extended vertically above the surface B has no counterpart on the opposite side surface of the barrier wall.

In the laying of a highway surface, it is generally required that the grade lines 37 and 38 be set such that a distance D of about three inches is provided between the highway surface 35 and the lower side of the wall surface portions A and B, respectively. This requirement of having the highway surface located three inches below the barrier surfaces A and B, in conjunction with the upward and inward inclination of the surfaces A and B, tends to bounce a vehicle away from the wall rather than having the vehicle follow or climb the wall so as to appreciably reduce vehicle damage and personal injury. Additionally, although the barrier wall 34 may have a maximum width over the lower portion thereof of about twenty-four inches, the width of the top wall surface may vary between six inches and twelve inches.

It is to be understood that the difference in elevation between the grade lines 37 and 38 due to the banking of the highway curves will vary according to the radius of the curve at any given point. Thus, in the construction of the barrier wall 34, the vertical dimension of the wall surfaces A1 and B2 may vary continuously throughout the length of the curve.

The concrete for constructing the barrier wall is carried by a conveyor means 39 (FIG. 1) for delivery into a hopper 41 that is carried on the forward end of the slip form 33.

Figure 2:
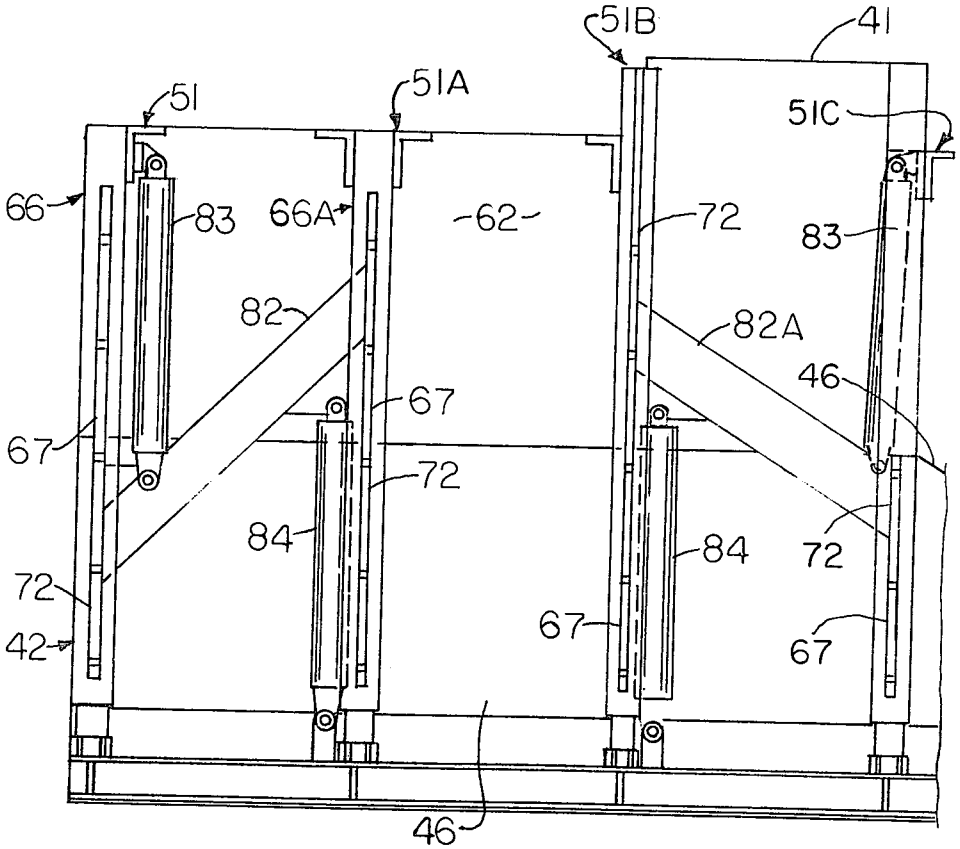
FIG. 2 is an enlarged side elevational view of the slip form of this invention showing the actuating mechanism for adjustably moving the side walls thereof.
Figure 4:
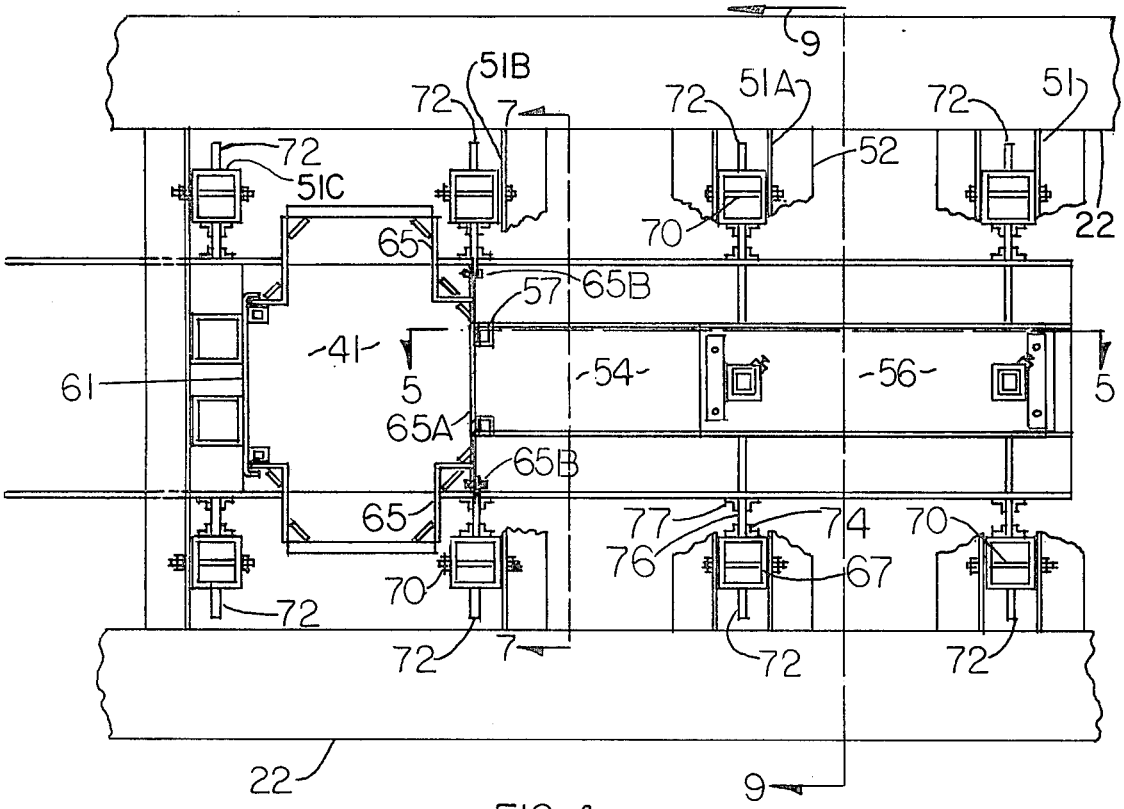
FIG. 4 is a plan view of the form and concrete receiving hopper and the supporting frame therefor, with portions broken away for clarity.

The slip form 33 of this invention (FIGS. 2 and 9) includes a pair of oppositely arranged side wall members 42 and 43, only the side wall 42 being shown in FIG. 2, and a top wall 44. Each side wall 42 and 43 includes an associated skirt member 46 and 47, respectively, movably supported for extension and retraction relative to the bottom edge of the side wall so as to constitute a lower extension therefor. The top wall 44 is adjustable for up and down movement relative to the frame 21 by means including upright telescoping units 48 each of which has an upper member 49 secured to an associated transverse bridge unit 51 and 51A extended between and connected to the upper side beams 22 of the frame 21. The bridge units 51, 51A, 51B and 51C, illustrated as four in number in FIG. 4, are spaced longitudinally of the frame 21 and include angle members 52 having upright flanges. These bridge units comprise a transverse supporting structure of the machine frame 21 that extends between and is connected to the upper ends of the frame side structures formed by the beam members 22 and 23.

Figure 5B:
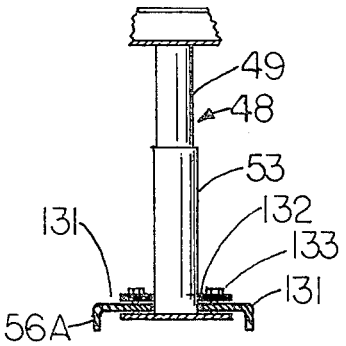
FIG. 5B is a sectional view on the line 5A—5A in FIG. 5B.
Figure 5A:
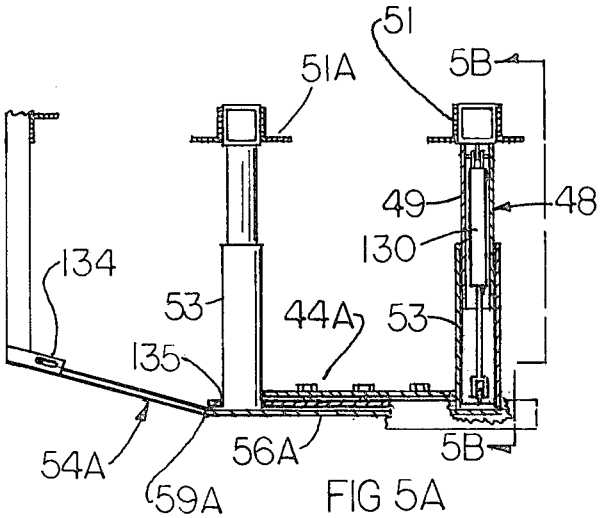
FIG. 5A shows a modified form of the top wall assembly shown in FIG. 5, with parts shown in section.
Figure 5:
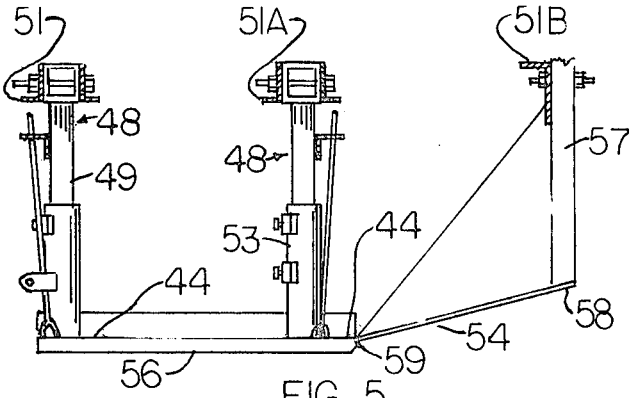
FIG. 5 is a side elevational view of the top wall assembly of the slip form as seen generally along the line 5—5 in FIG. 4.

As best appears in FIGS. 4 and 5, the top wall 44 is secured to lower members 53 of the telescopic units 48 and has a forward section 54 of a flat plate construction integrally formed with a rear section 56 of a generally channel shape faced downwardly. The rear section 56 is secured to the lower telescoping members 53 and the front end of the forward section 54 is connected to a pair of upright support members 57 that are mounted in depending relation from the bridge unit 51B which is located adjacent the rear side of the concrete hopper 41 (FIG. 4). The front end 58 of the forward section 54 defines the top wall of the hopper outlet through which concrete enters the slip form 33.

The forward section 54 (FIG. 5) of the top wall 44 is inclined downwardly and rearwardly from its front end 58 so as to direct concrete from the hopper 41 downwardly below the top wall rear section 56. Adjustment of the top wall rear section 56 thus takes place relative to the forward section 54 by flexing or bending thereof at the junction 59 of the sections 54 and 56. This adjustment, which moves the top wall 44 relative to the bridge units 51 and 51A, is accomplished by the provision of adjustable screw units 60 interconnecting the top wall rear section 56 with the upper telescoping members 49. By virtue of the flexing of the rear section 56 of the top wall 44 at 59, it will be appreciated that the rear section may tend to be inclined rearwardly from the flexing junction 59. However, this inclination does not alter the shaping or vertical height of the barrier top surface, which is controlled primarily by the rear end of the section 56, and facilitates the passage of concrete under the top wall 44.

Figure 6:
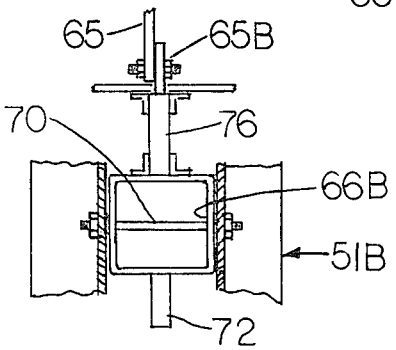
FIG. 6 is an enlarged detail view showing the securement of the concrete receiving hopper to the form for unitary movement therewith.

It is seen, therefore, that the form top wall 44 is carried directly on the bridge units 51A, 51B and 51C for vertical adjustment relative to the frame 21 independently of the form side walls 42 and 43, and the hopper 41, which except for the front wall portion 61 thereof (FIG. 4) is movable as a unit with the side walls 42 and 43. Thus, referring to FIGS. 4 and 6, rear side sections 65 of the hopper rear wall 65*a* are rigidly secured by bolts 65*b* to guide bars 74 which, as will appear later, are movable with the form side walls 42 and 43 and form part of the structure for guiding the up and down movement of the side walls 42 and 43 relative to the form top wall 44.

Figure 9:
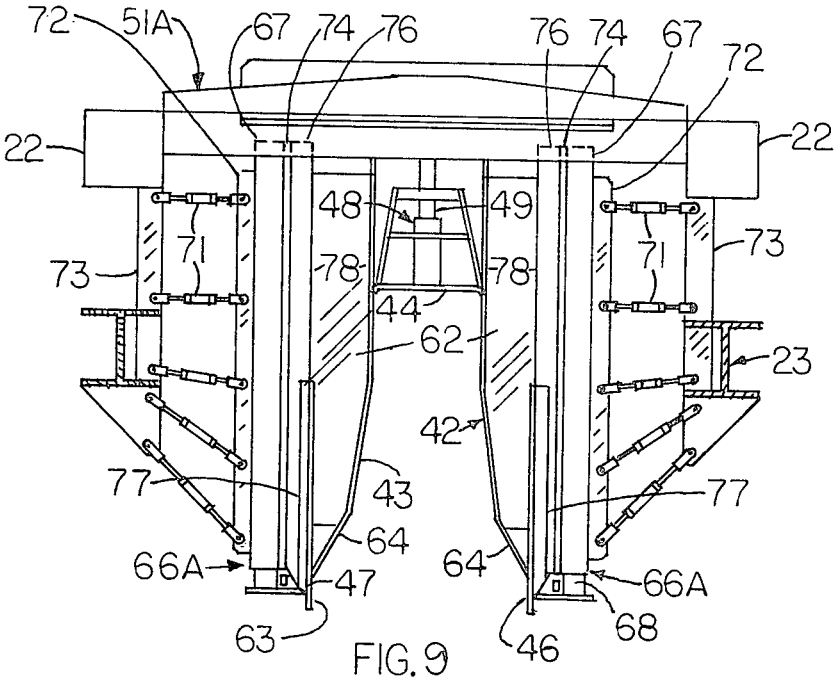
FIG. 9 is a sectional view as seen on line 9—9 in FIG. 4.

Each form side wall 42 and 43 (FIGS. 2 and 9) is comprised of a steel plate formed with an upper vertical section 62, a lower vertical extension or section 63, as formed by a skirt member 46 and 47, and an intermediate section 64 inclined generally upwardly and inwardly from the lower vertical section 63. As shown in FIG. 9, the sections 62 and 63 are arranged in parallel planes. The side walls 42 and 43 and the hopper 41 are supported for up and down unitary movement on the frame 21 by means including telescoping mounting units 66, 66A, 66B and 66C associated with the bridge units 51, 51A, 51B and 51C, respectively.

Figure 10:
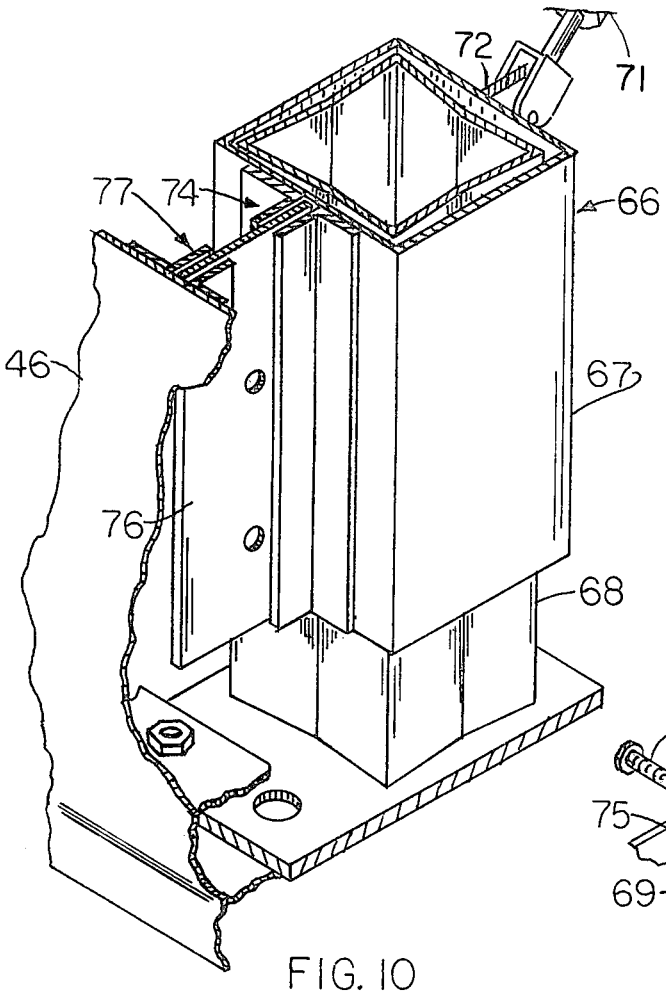
FIG. 10 is a detail perspective view of a telescopic mounting unit for movably supporting the side walls of the slip form of this invention for up and down movement.
Figure 10A:
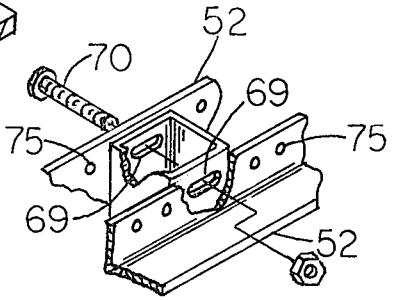
FIG. 10A is a detail perspective view, with parts broken away, showing the means for adjustably moving a telescopic mounting unit of FIG. 10 laterally of the form.

Each telescopic unit 66, 66A, 66B and 66C, and as shown for the unit 66 in FIG. 10, includes an outer member 67 of a tubular construction and of a square shape in transverse cross section for guidably receiving an inner tubular member 68. The outer guide member 67 is suspended from an associated bridge unit 51, 51A, 51B or 51C by means including a bolt member 70 (FIG. 10A) extended through openings 75 formed in the angle members 52 of a bridge unit and slotted openings 69 formed in the opposite side walls of an outer guide member adjacent the upper end thereof. By virtue of the multiplicity of openings 75 formed in the angle members 52 and the slotted formation of the openings 69, the outer guide members are movable in relatively small increments to a desired adjusted position laterally of the frame 21.

A guide member 67 (FIGS. 9 and 10) is rigidly maintained in a laterally adjusted upright position against pivotal movement about an associated bolt member 70 by a series of turn buckle units 71 connected at one end to a bar member 72 welded to and extended longitudinally of the outer surface of a guide member 67. The opposite end of the turn buckles 71 is connected to upright connecting plates 73 (FIG. 9) secured to and extended between the side beams 22 and 23 of the main frame 21.

The side of the tubular guide member 67 opposite the bar 72 (FIGS. 9 and 10) is provided with a longitudinally extended guideway 74 formed by a pair of facing angle irons. A guide bar 76 has one side portion receivable within the guideway 74 and an opposite side portion received within a guideway 77 formed on a skirt member 46 and 47 for the form side walls 42 and 43, respectively. An upright connecting plate 78 (FIG. 9) has one side secured by weldments to that portion of a guide bar 76 located above a skirt member 46 and 47, when the skirt member is in a fully retracted position relative to its associated side wall 42 and 43, respectively. A connecting plate 78 has a cutout portion of a length substantially equal to the vertical height of a skirt member and of a width equal to about the transverse dimension of a skirt member and guide 77 thereof. It is seen, therefore, that each side wall 42 and 43 and its associated telescopic units are laterally adjustable on the machine frame 21 to adjusted positions in conformance with the width of the form top wall 44 by simply inserting the supporting bolts 70 into selected openings 75 in the angle members 52 of the frame's transverse supporting structure.

Figure 3:
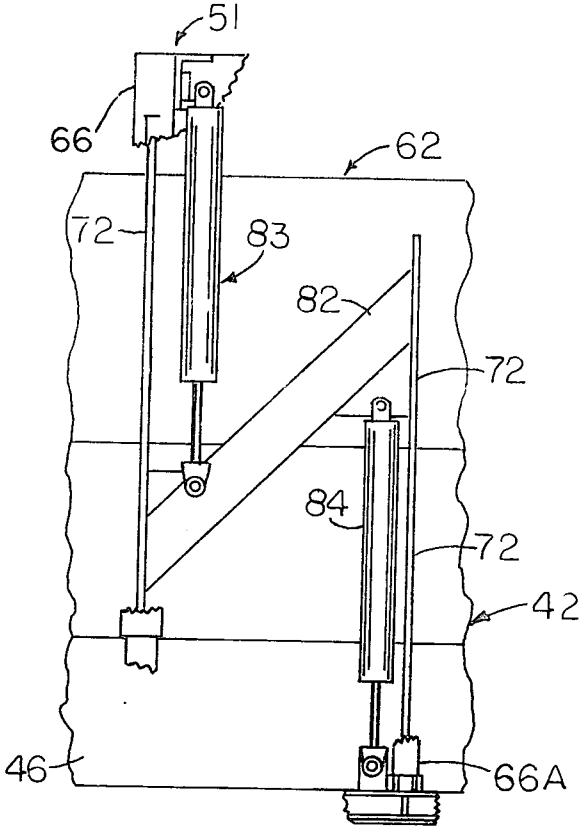
FIG. 3 is a diagrammatic illustration of a part of the actuating mechanism for the slip form shown in FIG. 2 with parts thereof in changed position.

As shown in FIGS. 2 and 3, for the form side wall 42, the guide bars 72 associated with the telescopic units 66 and 66A are secured together by horizontally inclined connecting bars 82. Similarly, the guide bars 72 associated with the telescopic units 66B and 66C are connected together by a connecting bar 82A. The lower end of each connecting bar 82 and 82A is pivotally connected to one end of an upright hydraulic cylinder unit 83, the upper end of which is pivotally connected to an associated bridge unit 51 and 51C, respectively. Each upper end of a connecting bar 82 and 82A is pivotally connected to an upright hydraulic cylinder unit 84, the lower end of which is pivotally connected to the lower side of a skirt member 46 and 47 of the form side walls. It is seen, therefore, that with the cylinders 84 retracted, extension of the cylinders 83 will move the form side walls 42 and 43, their associated skirt members 46 and 47, respectively, and the hopper 41 as a unit relative to the machine frame 21 and the form top wall 44. When the cylinder units 83 are in retracted positions, extension of the cylinder units 84 will result in only the up and down movement of the skirt members 46 and 47 relative to the side walls 42 and 43. In FIG. 3, all of the cylinders 83 and 84 are shown in extended positions to illustrate the relative movement between a side wall and skirt member. It will be noted that on disconnection of the cylinders 83 from either the bridge units or the connecting bars 82 and 82A, the slip form 33 is free to drop loose from the frame 21. Also, on disconnection of the cylinders 84 from the skirt members or connecting bars 82 and 82A, the skirt members are removable from the form side walls 42 and 43.

The movement of the slip form side walls 42 and 43 and their associated skirt members in an upright path is positively maintained by the guided support of the inner telescopic member 68 within the outer member 67 of a telescopic unit 66. Each inner member 68 is extensible and retractible relative to the lower end of an associated outer telescopic member 67 and is secured at its lower end to a skirt member 46 and 47 of the side walls 42 and 43, respectively. It is seen, therefore, that on operation of only the cylinders 83, the inner telescopic members 68 are movable as a unit with the side walls. However, when only the cylinders 84 are actuated, a skirt member and the inner telescopic members 68 are movable as a unit relative to an associated form side wall 42 and 43. The movement of a skirt member takes place relative to the guide bars 76 which are fixedly secured to corresponding connecting plates 78.

When the cylinder assemblies 83 and 84 are at rest, the form side walls 42 and 43 and associated skirt members are vertically movable as a unit with the frame 21 in the vertical adjustment of the form top wall 44 as determined by a guide line. Thus, referring to FIG. 1, there is illustrated a guide line 87 for determining the height of a barrier wall. What may be termed a "standard barrier wall" is indicated at 88 in FIG. 12 with the adjustment of the slip form 33 for forming the standard wall being shown in FIG. 11. The vertical height of the barrier wall 88 is initially determined by the guide line 87, shown in FIG. 1, which also determines the path of travel to be followed by the machine 20. The guide line is sensed by a sensing finger 89 which is connected to appropriate control means 91 mounted on the frame 21 for control of the vertical movement thereof with the form top wall 44. Since the guide line 87 is installed to vertically vary in accordance with grade variations to be followed by the barrier wall being formed, the configuration of the barrier wall may be infinitely varied along the length of the wall.

With the initial height of the barrier wall 88 determined by adjustment of the top wall 44 in conformance with the setting of the guide line 87, the side walls are vertically adjusted to provide the necessary wall configuration and vertical height of the wall portions A and B (FIG. 14) above the highway surface 35 to be laid. Thereafter, the slip form 33 and frame 21 will be movable up and down as a unit in response to grade variations predetermined by the guide line 87. This vertical adjustment of the frame 21, as previously mentioned, is obtained through the linear adjustment of the members 31. It is contemplated that only the pair of ground supporting units 26 adjacent the guide line 87 be adjusted in conformance with the grade level as set by the guide line, and that the opposite pair of ground units be adjusted by conventional slope control mechanism (not shown) carried on the machine frame 21 for such purpose.

In operation, the machine 20 may be located over a foundation for the barrier wall so that the lower edges of the skirt members 46 and 47 are substantially disposed upon or adjacent the top surface of the foundation. The vertical height of the top wall 44 is adjusted by the cylinder assemblies 29 and adjusting units 60 for conformance with the grade line 87, after which the form side walls 42 and 43 are moved to their operating positions relative to the grade level. The drive motors 28 for the endless tracks 27 are then operated to slowly move the machine in the direction of the conveyor 39, concrete to which is continuously supplied from ready mix concrete trucks. The concrete delivered by the conveyor 39 drops into the hopper 41. As previously noted, the hopper 41 is vertically movable as a unit with the side walls of the slip form 33.

Figure 7:
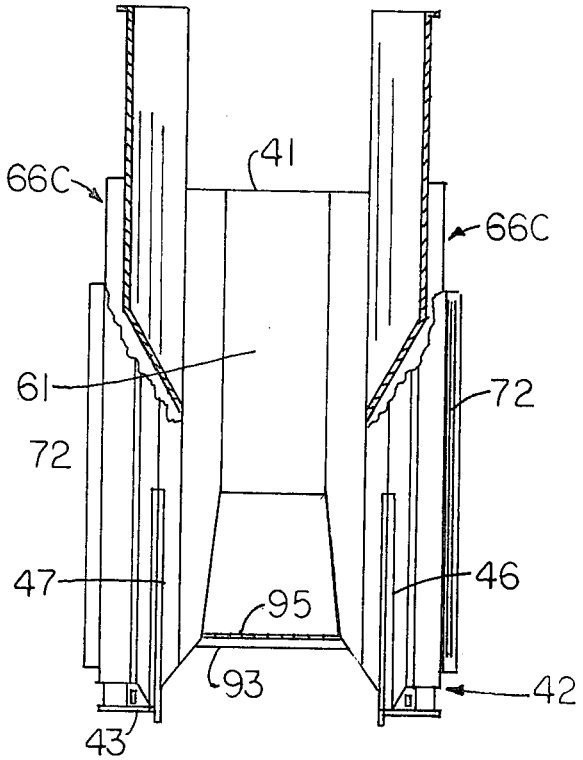
FIG. 7 is a sectional view taken along the line 7—7 in FIG. 4, showing the assembly relation of the slip form with the front wall of the concrete receiving hopper therefor.
Figure 8:
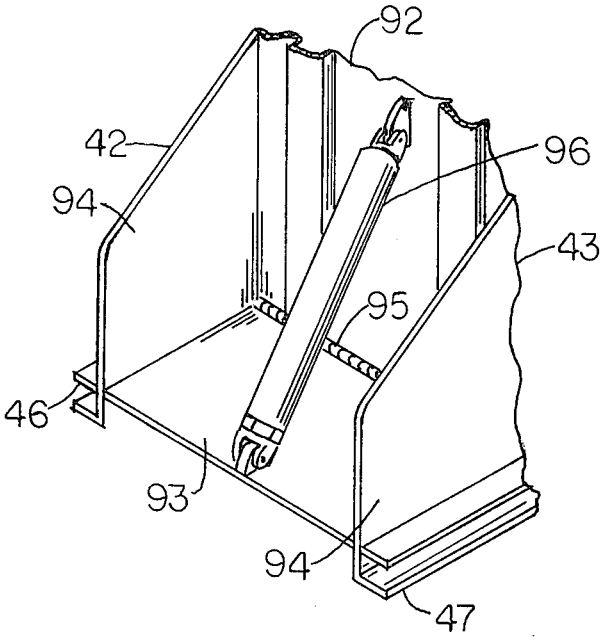
FIG. 8 is an enlarged detailed perspective view of an adjustable gate shown in FIG. 7 for the front wall of the concrete receiving hopper.

To assure the hopper being filled so as to properly form the barrier wall as the machine 20 is advanced, there is provided at the lower edge 90 of the hopper front wall 61 (FIGS. 7 and 8) a closure gate 93 for preventing any flow of concrete from beneath the lower edge of the hopper front wall. The gate 93 extends between the forward ends 94 of the skirt members 46 and 47 and has the rear side thereof pivotally connected at 95 to the lower side of the hopper front wall 61. The front end of the closure plate is pivotally movable toward and away from the ground surface under the control of a manually operated hydraulic cylinder unit 96 which interconnects the front wall 61 and the pivoted closure member 93.

Figure 11:
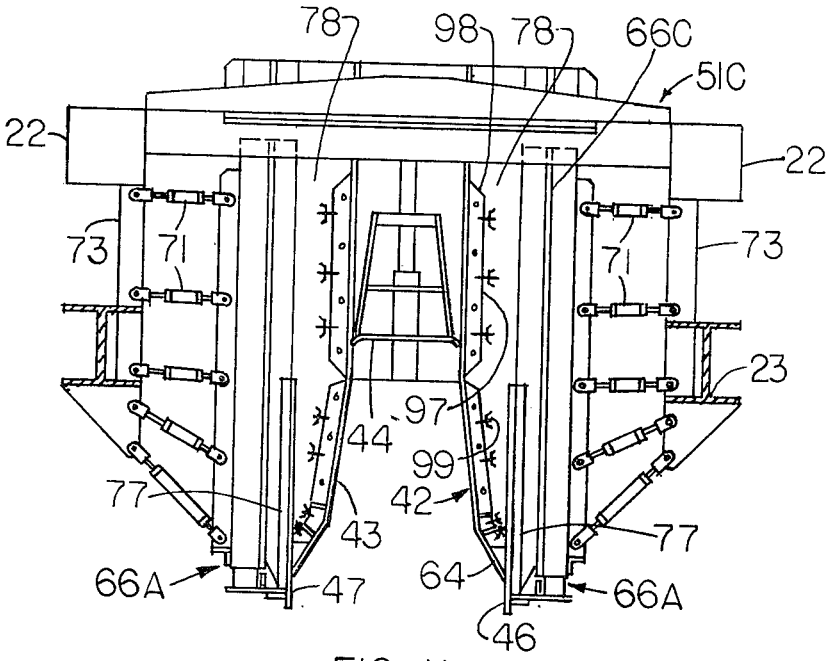
FIG. 11 is a rear elevational view of the slip form in one moved position therefor and showing an adjustable trowel portion for finishing the surface areas of the barrier wall.
Figure 12:
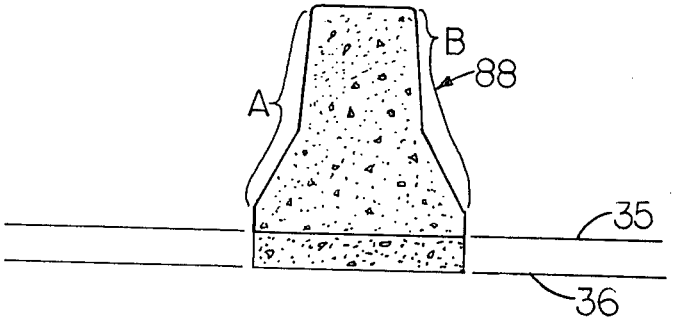
FIG. 12 is a diagrammatic illustration showing the symmetrical transverse cross sectional shape of a barrier wall formed by the slip form when in its position of FIG. 11.

As illustrated in FIGS. 11 and 12, the barrier wall 88 is of a standard type that is symmetrical relative to a vertical plane therethrough and with the side surfaces thereof being made in conformance with substantially the contour of the lower vertical sections 63 and intermediate sections 64 of the side walls 42 and 43. In this respect, it will be noted that only a small portion of the upper vertical sections 62 project downwardly below the top wall 44 of the slip form and that the surface portions A and B of the wall 88 are located about three inches above the surface of the finished highway 35.

In FIG. 11, the slip form 33 is viewed from the rear end thereof with the bridge unit 51 and telescopic unit 66 being illustrated to provide for a final finishing of the side surface areas of the barrier wall 88. The connecting plates 78 between the form side walls 42 and 43 and the guide bars 76 are secured to the form side walls 42 and 43 by bolts 97 extended through connecting bars 98 welded to the side walls 42 and 43 and through slotted openings formed in the connecting plates 78. Adjustable units 99 interconnect the bars 98 with the connecting plates 78. With the bolts 97 loosened, the adjustment of the units 99 provides for minor adjustments in the configuration of the form side walls at the rear end portions thereof. The adjusted configuration changes correct any surface irregularities or defacements such as raised or depressed portions that may show up in the initial passage of the barrier wall through the form.

Figure 13:
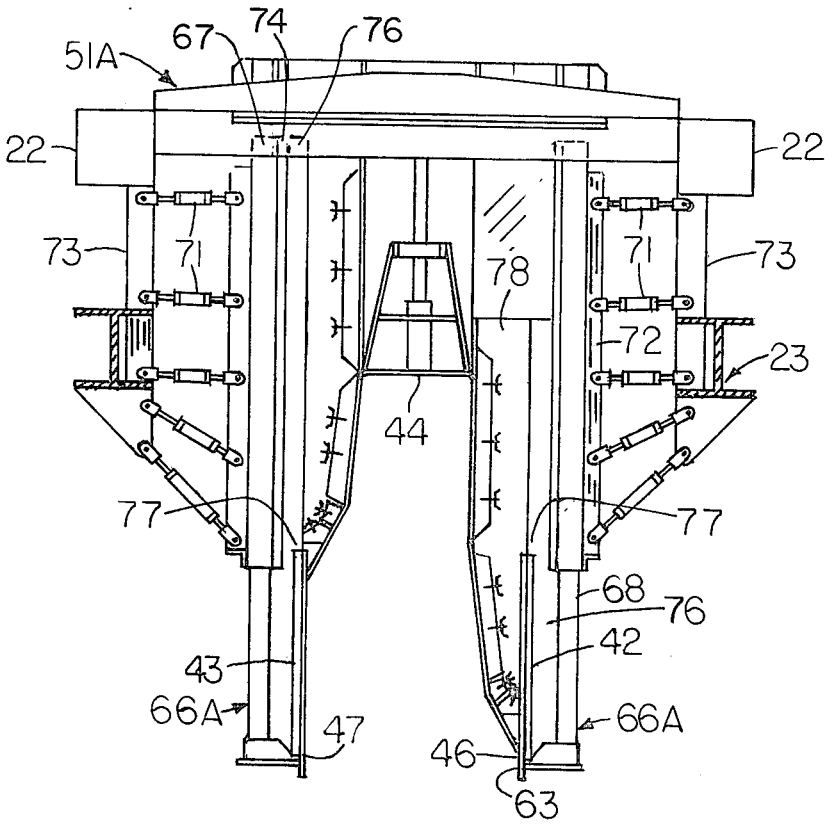
FIG. 13 is illustrated similarly to FIG. 11 and shows the form in another moved position therefor.

FIG. 13 illustrates the adjustment of the form side walls 42 and 43 and top wall 44 in the forming of a barrier wall 34 of FIG. 14, which was previously described. This barrier wall is of a non-symmetrical shape relative to a vertical plane extended centrally therethrough. This non-symmetrical wall shape is of a usual type formed in following a curved highway resulting in a vertical displacement between the grade levels 37 and 38 of the highway surface 35 to opposite sides of the wall. As shown in FIG. 13, the form side wall 43 and the skirt member 47 therefor have been extended downwardly as a unit by its associated cylinder assemblies 83 whereas the side wall 42 has been maintained in its upper position by retraction of its associated cylinder assemblies 83 and the extension of the respective skirt member 46 from the lower edge thereof in response to extension of the hydraulic cylinder assemblies 84 associated therewith.

Figure 15:
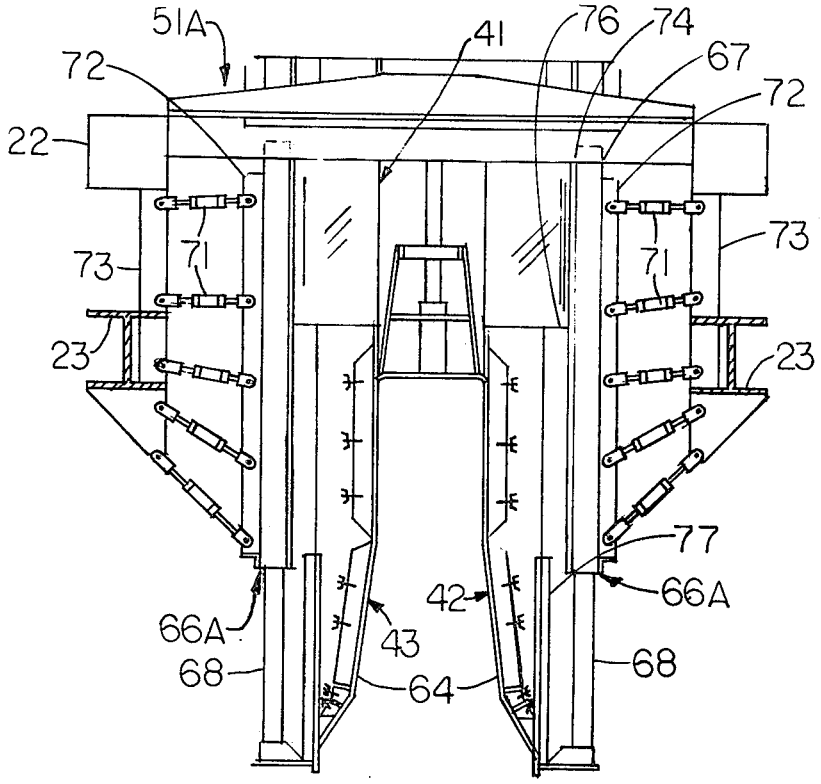
FIG. 15 is illustrated similarly to FIG. 11 and shows a moved position of the form wall for forming a glare shield on the top surface of the barrier wall shown in FIG. 12.
Figure 16:
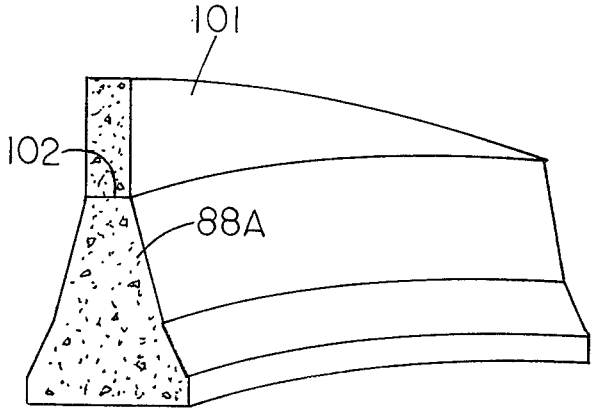
FIG. 16 is a diagrammatic illustration showing the barrier wall and glare shield therefor formed by the slip form when in its position of FIG. 15.

In FIG. 15, the slip form 33 is shown in a moved position for forming a glare shield 101 projected upwardly from the top surface 102 of a standard type barrier wall 88A. In this respect, it is seen that the form side walls 42 and 43 are moved to their lowermost positions by the hydraulic cylinder assemblies 83 so as to increase the vertical height of the barrier wall 88A by an amount substantially equal to the vertical extent of the upper sections 62 of the form side walls. Importantly, it is seen that the glare shield 101 is formed simultaneously with the forming of the barrier wall 88A. This is accomplished by merely including the desired linear extent and vertical height of the glare shield 101 with the grade variations in the guide or grade line 87.

In the forming of the barrier walls, the cylinder assemblies 84 for the skirt members are controlled by an operator walking along side of the machine 20 during the advance thereof to move the skirt members relative to the grade level as may be necessary to prevent the flow of any concrete from underneath a form side wall. In some instances, such as in the forming of the glare shield 101, it may be desirable to relatively adjust the form top wall 44 and the side walls 42 and 43. This may be readily accomplished by adjustably moving the top wall by a hydraulic cylinder unit 130 (FIG. 5A) positioned within each telescopic assembly 48 and interconnecting the top wall 44A with an associated bridge unit 51 and 51A. The top wall 44A (FIGS. 5A and 5B) has a rear section 56A of a flat plate construction secured to the lower ends of the telescopic members 53, and connected to the cylinder units 130. Side extensions 131 for the rear section 56A are adjustable laterally of the rear section in a guideway formed by the top surface of the rear section and a guide plate 132 secured to the telescopic members 53 in a spaced relation above and parallel to the rear section 56A. The extensions 131 are held in laterally adjusted positions by friction or clamping screws 133 which are threadable in the guide plate 132 to engage and clamp the extensions against the rear section 56A of the top wall 44A. The guide plate 132 extends between the telescopic units 48 and the extensions are coextensive in length with the rear section 56A, being notched, as indicated at 135, to receive a lower member 53 therebetween.

The front section 54A of the top wall 44A has its forward end in a lost motion hinged connection 134 with the front wall of the hopper 41. By virtue of this hinged connection 134, the top wall 44A is thus provided with both a pivotal and linear movement at the hinge 134 and a flexing movement at the junction 59A of the sections 54A and 56A. The top wall 44A is thus vertically adjustable in response to extension and retraction of the cylinder units 130, relative to the side walls 42 and 43. By virtue of the side extensions 131, the width of the top wall 44A is adjustable to form, with a single pair of laterally adjustable side walls, barrier walls varying in both height and thickness but having side surfaces of similar configuration.

It is seen, therefore, that the slip form 33 provides for the continuous forming of a barrier wall, with an uninterrupted advance of the machine 20 in one direction, regardless of whether the wall is to follow double or reversed highway curves, or is to be provided over any section thereof with a glare shield. Also, by virtue of the support of the form top wall 44 on the frame 21 independently of the side walls 42 and 43, in conjunction with adjustment of the side walls laterally of the frame for contact engagement of their upper sections 62 with opposite sides of the top wall, a single pair of side walls can be used with top walls of varying widths to form barrier walls of varying height and thickness. In turn, side walls of varying configuration can be utilized with top walls of varying width. This interchangeability of the form side walls and top wall eliminates the cost involved in the maintaining on hand a number of separate forms each of which is limited to forming a particular shaped or dimensioned wall.

Figure 17:
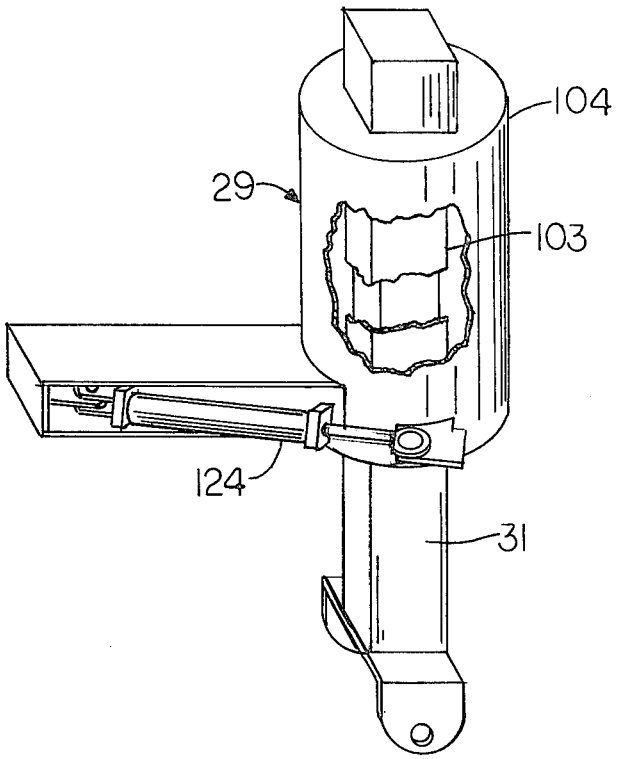
FIG. 17 is a perspective view showing a grade conforming connection between the machine frame and a traction device therefor in an extended position therefor, with some of the parts being broken away and other parts shown in section for the purpose of clarity.

The cylinder assemblies 29 for vertically moving the main frame 21 and slip form in conformance with the sensing of the grade line 87 each includes the linear adjustable unit 31 (FIGS. 17 and **17*a*). The member 31 is of a rectangular shape in transverse cross section and is slidably received within a correspondingly shaped tubular member 103 for telescoping guided movement therein. The telescoping unit comprised of the members 51 and 103 are received, when in a telescopic closed relation, within a cylindrical housing 104. Extended longitudinally within the adjustable member 31 and located within the housing 104 is a hydraulic cylinder 106 having one end connected to the closed upper end 107 of the outer guide member 103 and its opposite or lower end connected by a wrist pin 108 with the adjustable member 31. The member 31 is thus extended and retracted relative to the outer guide member 103 by the hydraulic cylinder 106 which is operated in response to the sensing action of the sensing finger 89 on the guide line 87**.

Figure 18:
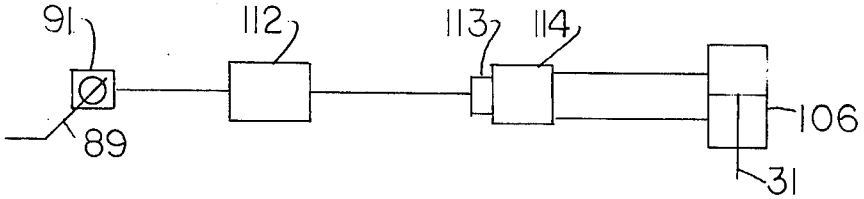
FIG. 18 is a diagrammatic showing of the control circuit for the grade conforming device shown in FIG. 17.

The sensing finger 89 controls the vertical adjustment of the members 31 for the ground units 26 at the left side of the machine 20, as it advances along the grade line 87, and this adjustment is transferred to the right hand ground units 26 by a slope control unit (not shown) mounted on the frame 21. The control circuit for the right hand ground units 26 operates independently of the control circuit for the left hand ground units 26. However, since the circuits are identical for controlling the extension or retraction of the adjustable members 31, only the circuit for the left hand ground units 26 is shown and described in FIG. 18. This circuit for the left hand ground units includes a Model ACX104B grade sensor 91 produced by Honeywell, Inc., as are all of the components of the circuit.

The grade sensor has a movable sensing finger 89 in contact with the grade line 87 along which the machine 20 travels to provide a grade control signal of from zero to six volts DC.

The control signal from the sensor 91 is supplied to a Model ACE100 differential amplifier 112 and is compared with a base signal indicative of a zero grade for the machine frame 21. The difference between the control signal and the base signal is then furnished as an error signal to a servomotor 113. A valve spool in a fluid control valve 114 is actuated by the servomotor 113 to supply hydraulic fluid to extend or retract an associated hydraulic cylinder 106 to extend or retract the adjustable member 31.

The machine 20 is automatically steered in a following relation with the guide line 87 by sensing fingers 118 and **118*a* arranged respectively. In other words, the finger 118*a* provides for a steering of the front pair of ground supporting units 26 and the finger 118 the steering of the rear pair of ground supporting units 26**.

Figure 19:
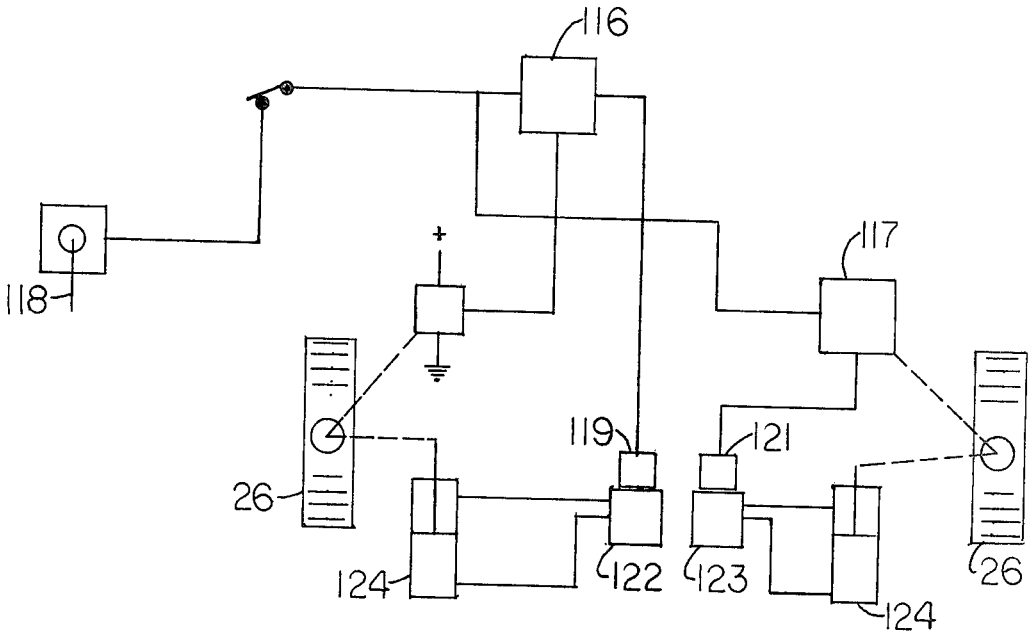
FIG. 19 is a diagrammatic illustration of the control circuit for automatically steering the traction units in response to the path of movement defined by a grade line.

The front and rear pair of track units 26 of the machine are electronically controlled for steering purposes by independent but identical circuits for each track pair. Each circuit (FIG. 19) includes differential amplifiers 116 and 117 that receive a steering control signal from a steering sensor 118 or **118*a*, and a track alignment signal indicative of the alignment of the associated pair of tracks. In response thereto, the differential amplifiers 116 and 117 each provide an error signal to a servomotor 119 or 121, respectively. The servomotors 119 and 121 regulate hydraulic flow control valves 122 and 123 to supply hydraulic fluid to extend or retract hydraulic cylinder assemblies 124 (FIG. 17) for turning an associated track unit 26**.

Figure 17A:
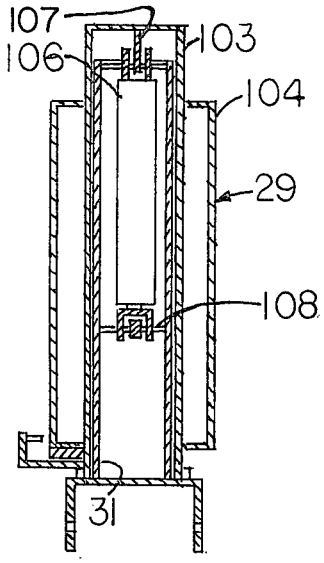
FIG. 17A is a longitudinal sectional view of the device of FIG. 17 shown in the retracted position therefor.

As previously noted, the cylinder assemblies (FIGS. 1 and 17) associated with the track units 26 and functioning as grade conforming connections between the frame 21 and the track units, are supported from the frame by the horizontally swingable parallel link systems 32. The housing 104 is formed as a unit part of a link for connecting the outer ends of the parallel arms 32*a* (FIG. 1) with the frame 21 constituting the connecting link for the inner ends of the parallel arms 32*a*. Thus, with the guide tube 107 (FIG. 17A) fixed to the housing 104 to position a track unit 26 in longitudinal alignment with the frame 21, such alignment is maintained for all steered positions of a track unit and vertically adjusted positions of the frame 21.

It is to be understood that the machine 20 is equipped with a power supply such as an internal combustion engine (not shown) for operating pump units (not shown) for supplying oil under pressure to the cylinders 83, 84, 96, 106 and 124 and to the hydraulic motors 28. Control of the cylinders is from a control unit 126 carried on the frame 21. A control unit 91 for operating the cylinders 83, 84 and 96 may be mounted on the frame 21 for convenient accessibility by an operator observing the surface clearance of the form 33 from a ground position.

Although the invention has been described with respect to a preferred embodiment thereof, it is to be understood that it is not to be so limited since changes and modifications can be made therein which are within the full intended scope of this invention as defined by the appended claims.

I claim:

1. In a machine for slip forming a median wall barrier wherein the upper surface of the wall is maintained at a predetermined grade level, the combination comprising:

(a) a portable frame means, (b) means supporting said frame means for moving engagement with a ground surface, (c) said frame means including a pair of transversely spaced upright side structures and an upper supporting structure extended between and secured to said side structures adjacent the upper ends thereof, (d) a slip form located between said side structures and extended longitudinally of said frame means, said slip form comprising:

(1) a top wall member secured in a suspended relation from said supporting structure, and (2) a pair of upright side wall members arranged at opposite sides of said top wall member having upper portions adjacent to and projected upwardly from said top wall member, (e) means movably supporting said side wall members on said frame means for up and down movement relative to said top wall member, (f) means on said supporting structure for independently moving said side wall members relative to said top wall member, (g) coacting means on said supporting structure and upright side structures for adjustably moving the side wall members toward and away from each other to position the upper portions of said side members adjacent opposite sides of said top member; and (h) grade conforming connections between said frame supporting means and said frame means to conform said slip form to said predetermined grade level.

2. In a machine for slip forming a median wall barrier wherein the upper surface of the wall is maintained at a predetermined grade level, the combination comprising:

(a) a portable frame means, (b) means supporting said frame means for moving engagement with a ground surface, (c) a slip form unit carried on the frame means for forming said median wall, said slip form unit comprising:

(1) a top wall, a pair of side walls having upper portions and lower portions, said upper portions arranged at opposite sides of and in contact engagement with said top wall, (d) means supporting said top wall in an adjustable suspended relation from said frame means for up and down movement, (e) means movably supporting said side walls in a suspended relation from said frame means for up and down movement including means for adjusting said side walls laterally of said top wall to position said upper portions in contact engagement with said top wall, (f) adjustable means for rigidly interconnecting said side wall supporting means and said frame means at laterally adjusted positions of said side walls, (g) means connected to said frame means and side walls for moving said side walls relative to said ground surface, and (h) grade conforming connections between said portable frame means and said portable frame supporting means for conformance of said top wall with said predetermined grade level.

3. The machine according to claim 2, wherein:

(a) said slip form unit includes a concrete receiving hopper at the forward end thereof having a front wall structure with a movable lower portion, and (b) means for moving said movable lower portion relative to said ground surface for conformance with varying grade conditions of said ground surface to prevent the flow of concrete from beneath said front wall.

4. The machine according to claim 2, wherein:

(a) said top wall includes a body member of a plate construction and of a rectangular shape in plan view, (b) laterally adjustable side extensions for said body member, and (c) means adjustably supporting said extensions on said body member to laterally adjusted positions therefor to vary the width of the upper surface of the barrier wall.

5. The machine according to claim 4, wherein:

(a) said supporting means for the top wall includes means for adjusting said top wall up and down relative to said side walls to a position in conformance with the height of the barrier wall to be formed.

6. The machine according to claim 5, including:

(a) an adjustable skirt member for the lower portion of each side wall, (b) means supporting a skirt member for up and down movement relative to an associated lower portion, and (c) means connected to said frame means and skirt members for moving said skirt members relative to said ground surface, (d) said side walls, top wall and skirt members being independently movable relative to each other, and each side wall and associated skirt member being movable together as a unit.

* * * * *